US007051920B1

(12) United States Patent
Asch

(10) Patent No.: US 7,051,920 B1
(45) Date of Patent: May 30, 2006

(54) MAIL RETRIEVAL SYSTEM

(76) Inventor: James Asch, 7217 Jefferson Ave., Hammond, IN (US) 46324

( * ) Notice: Subject to any disclaimer, the term of this patent is extended or adjusted under 35 U.S.C. 154(b) by 108 days.

(21) Appl. No.: 10/782,066

(22) Filed: Feb. 19, 2004

(51) Int. Cl.
*A47G 29/12* (2006.01)

(52) U.S. Cl. ..... 232/39; 104/177

(58) Field of Classification Search ..... 232/39, 232/17; 107/177; 248/128, 298.1; 104/178
See application file for complete search history.

(56) References Cited

U.S. PATENT DOCUMENTS

| | | | | |
|---|---|---|---|---|
| 986,011 | A | 3/1911 | Kinney | |
| 1,113,451 | A | 10/1914 | Levasseur et al. | |
| 1,260,877 | A | 3/1918 | Cunningham | |
| 1,404,679 | A * | 1/1922 | Antholz | 104/177 |
| 2,108,453 | A * | 2/1938 | Spencer | 104/177 |
| 2,179,913 | A * | 11/1939 | Bess | 104/303 |
| 2,425,141 | A * | 8/1947 | Bernau | 198/686 |
| 2,819,684 | A * | 1/1958 | Nohr | 104/117.1 |
| 3,066,616 | A * | 12/1962 | Weisberg | 104/172.3 |
| 3,315,615 | A * | 4/1967 | Nydegger et al. | 104/177 |
| 4,403,760 | A * | 9/1983 | Alvermann | 248/284.1 |
| 4,869,426 | A * | 9/1989 | Powers et al. | 232/39 |
| 6,161,756 | A * | 12/2000 | Upton | 232/39 |
| 6,533,167 | B1 * | 3/2003 | Hassan | 232/45 |

* cited by examiner

*Primary Examiner*—William L. Miller

(57) ABSTRACT

A mail retrieval system for allowing a user to limit exposure to the elements while retrieving mail. The mail retrieval system includes a support assembly extending between a curb and a house. A mail receiving member is coupled to the support assembly whereby the mail receiving member is selectively transported along the support assembly. The mail receiving member is designed for receiving mail. The mail receiving member permits a user to retrieve the mail when the mail receiving member is transported along the support assembly to be positioned proximate the house. A drive assembly is coupled to the support assembly. The drive assembly is operationally coupled to the mail receiving assembly for transporting the mail receiving member along the support assembly when the drive assembly is actuated by the user to allow the user to retrieve the mail in the mail receiving box without having to walk to the curb.

14 Claims, 2 Drawing Sheets

MAIL RETRIEVAL SYSTEM

BACKGROUND OF THE INVENTION

1. Field of the Invention

The present invention relates to mail carrier devices and more particularly pertains to a new mail retrieval system for allowing a user to limit exposure to the elements while retrieving mail.

2. Description of the Prior Art

The use of mail carrier devices is known in the prior art. U.S. Pat. No. 1,260,877 describes a device for transporting mail from one location to another. Another type of mail carrier device is U.S. Pat. No. 1,113,451 having a suspended trolley connected to a mail box for allowing mail to be delivered from a roadside to the house a distance away. U.S. Pat. No. 986,011 has a suspended system for retrieving a mail box from a remote location and transporting the mail box to the house.

While these devices fulfill their respective, particular objectives and requirements, the need remains for a system that has certain improved features that makes the retrieval of the mail box less susceptible to failure due to inclement weather.

SUMMARY OF THE INVENTION

The present invention meets the needs presented above by providing a carriage member sliding along a rail member which allows the mail box to be retrieved with little disruption for the weather.

Still yet another object of the present invention is to provide a new mail retrieval system that allows the user to remote signal the retrieval of the mail receiving member.

Even still another object of the present invention is to provide a new mail retrieval system that can handle heavy loads in the mail receiving member without affecting performance.

To this end, the present invention generally comprises a support assembly being designed for being positioned on a support surface whereby the support assembly extends between a curb and a house. A mail receiving member is coupled to the support assembly whereby the mail receiving member is selectively transported along the support assembly. The mail receiving member is designed for receiving mail when the mail receiving member is positioned adjacent the curb. The mail receiving member permits a user to retrieve the mail when the mail receiving member is transported along the support assembly to be positioned proximate the house. A drive assembly is coupled to the support assembly. The drive assembly is operationally coupled to the mail receiving assembly whereby the drive assembly is for transporting the mail receiving member along the support assembly when the drive assembly is actuated by the user to allow the user to retrieve the mail in the mail receiving box without having to walk to the curb.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
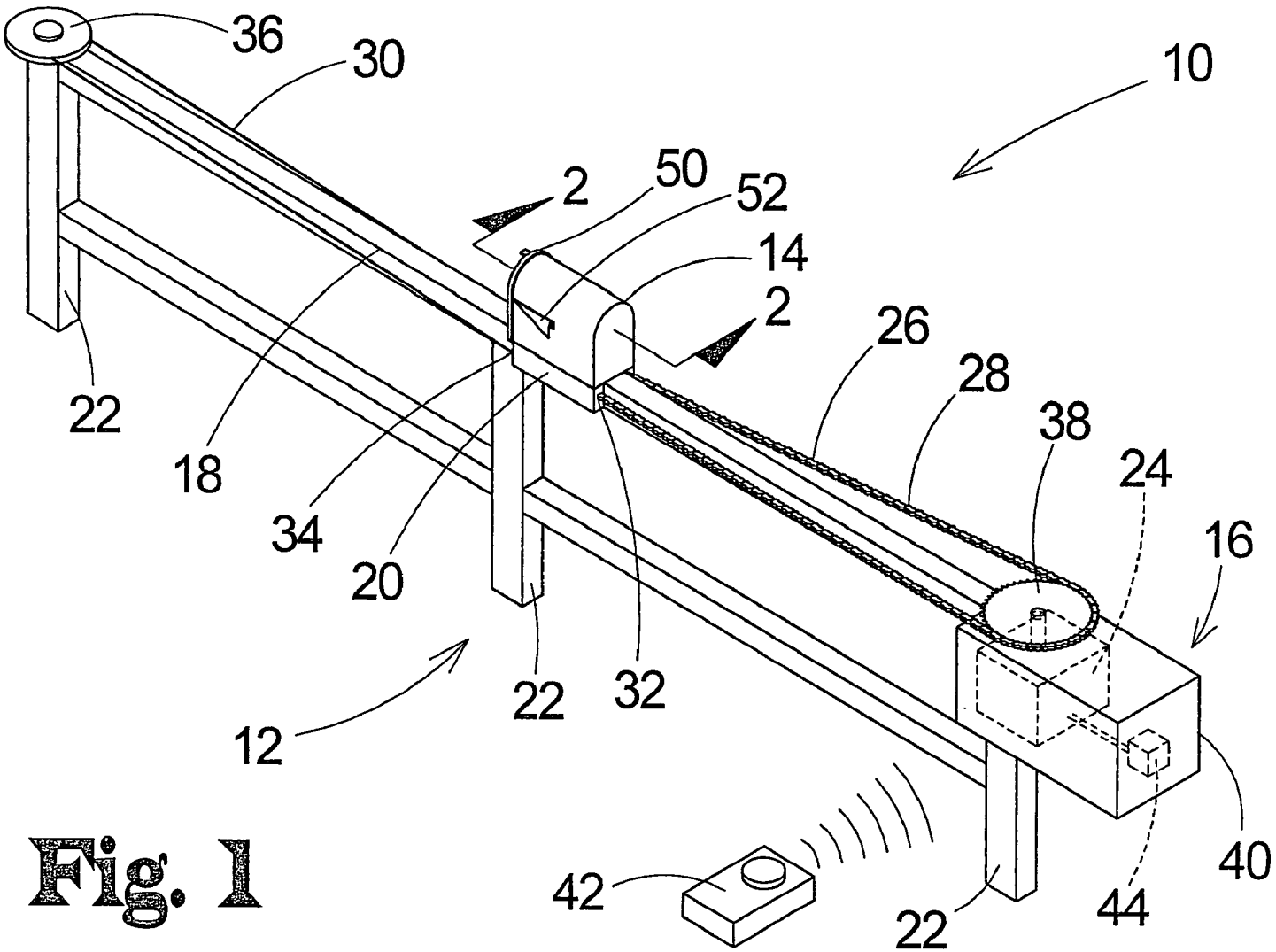
FIG. 1 is a perspective view of a new mail retrieval system according to the present invention.
Figure 2:
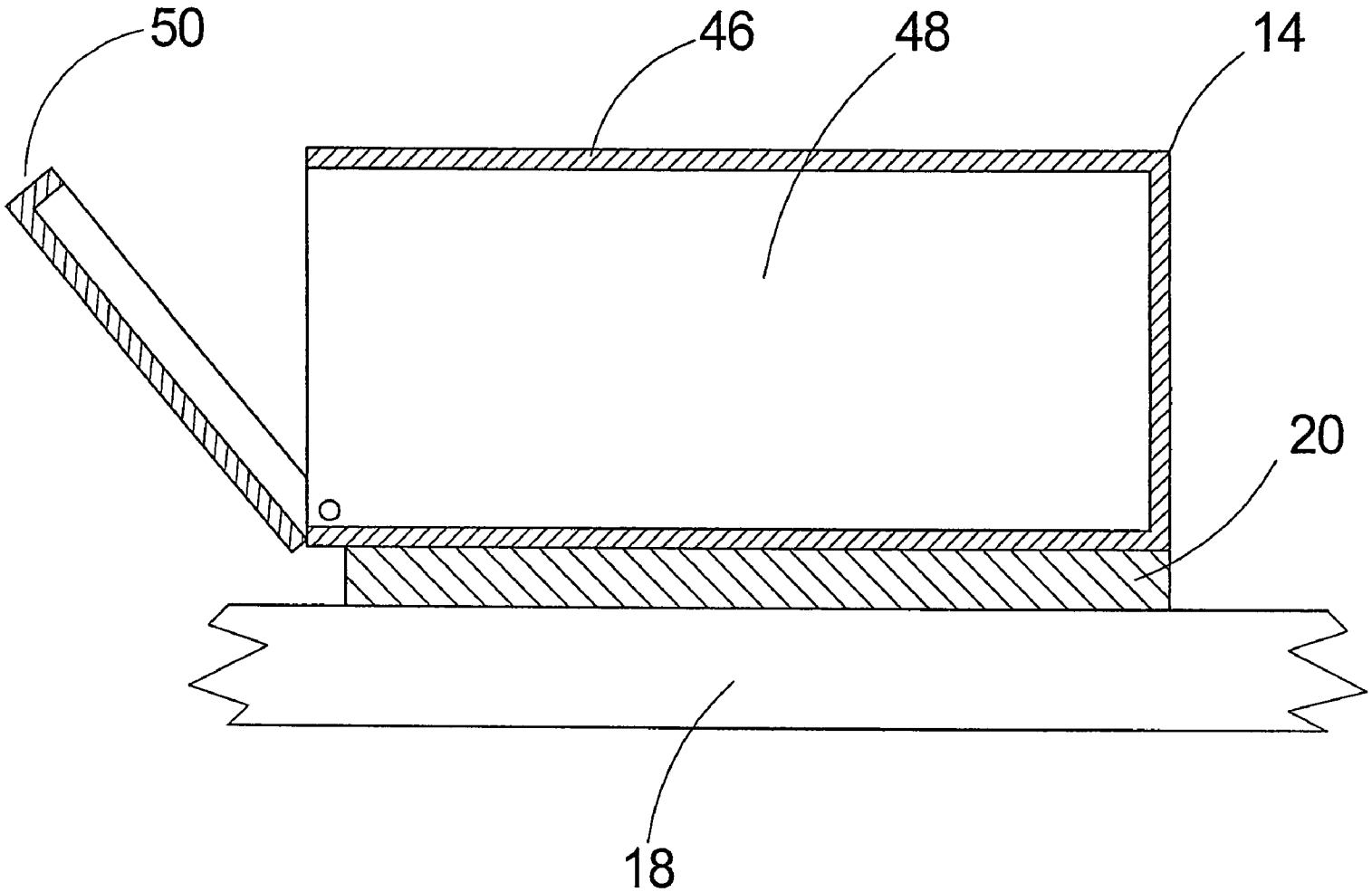
FIG. 2 is a cross-sectional view of the present invention taken along line 2—2 of FIG. 1.

With reference now to the drawings, and in particular to FIGS. 1 through 2 thereof, a new mail retrieval system embodying the principles and concepts of the present invention and generally designated by the reference numeral 10 will be described.

As best illustrated in FIGS. 1 through 2, the mail retrieval system 10 generally comprises a support assembly 12 being designed for being positioned on a support surface whereby the support assembly 12 extends between a curb and a house.

A mail receiving member 14 is coupled to the support assembly 12 whereby the mail receiving member 14 is selectively transported along the support assembly 12. The mail receiving member 14 is designed for receiving mail when the mail receiving member 14 is positioned adjacent the curb. The mail receiving member 14 permitting a user to retrieve the mail when the mail receiving member 14 is transported along the support assembly 12 to be positioned proximate the house.

A drive assembly 16 is coupled to the support assembly 12. The drive assembly 16 is operationally coupled to the mail receiving assembly whereby the drive assembly 16 is for transporting the mail receiving member 14 along the support assembly 12 when the drive assembly 16 is actuated by the user to allow the user to retrieve the mail in the mail receiving box without having to walk to the curb.

The support assembly 12 comprises a rail member 18 and a carriage member 20. The carriage member 20 is slidably coupled to the rail member 18 whereby the carriage member 20 selectively slides along a length of the rail member 18. The carriage member 20 is operationally coupled to the drive assembly 16 whereby the drive assembly 16 is for sliding the carriage member 20 along the rail member 18 when the drive assembly 16 is actuated by the user. The mail receiving member 14 is coupled to the carriage member 20 whereby the mail receiving member 14 is transported along the rail member 18 when the carriage member 20 is slid along the rail member 18 by the drive assembly 16.

The support assembly 12 comprises a plurality of stanchion members 22. Each of the stanchion members 22 is coupled to the rail member 18. Each of the stanchion members 22 is designed for engaging the support surface whereby the stanchion members 22 are for supporting the rail member 18 above the support surface.

The drive assembly 16 comprises a motor member 24. The motor member 24 is operationally coupled to the carriage member 20 of the support assembly 12 whereby the motor member 24 is for sliding the carriage member 20 along the rail member 18 when the drive assembly 16 is actuated by the user. The motor assembly is reversed each time the motor assembly is actuated whereby the motor assembly slides the carriage member 20 away from the motor member 24 upon actuation of the drive assembly 16 and slides the carriage member 20 towards the motor member 24 upon alternating actuations of the drive assembly 16. The motor assembly is designed for being operationally coupled to a power source for supplying power to the motor member 24.

The drive assembly 16 comprises a drive member 26. The drive member 26 is operationally coupled between the motor member 24 and the carriage member 20. The drive assembly 16 is actuated by the motor assembly to slide the carriage member 20 along the rail member 18 when the drive assembly 16 is actuated by the user.

The drive member 26 comprises a chain portion 28 and a cable portion 30. The chain portion 28 is coupled to the cable portion 30. A free end 32 of the chain portion 28 is coupled to the carriage member 20. A distal end 34 of the cable portion 30 is coupled to the carriage member 20 opposite the free end 32 of the chain portion 28. The chain portion 28 of the drive member 26 is operationally coupled to the motor member 24 whereby the free end 32 of the chain portion 28 is selectively drawn closer to the motor assembly to slide the carriage member 20 along the rail member 18 towards the motor member 24 when the drive assembly 16 is actuated by the user. The cable member is operationally coupled to the support assembly 12 such the chain portion 28 pulls on the cable portion 30 to draw the distal end 34 of the cable portion 30 away from the motor member 24 to slide the cable assembly along the rail member 18 away from the motor member 24 upon alternating actuations of the drive assembly 16.

The drive assembly 16 comprises a pulley member 36. The pulley member 36 is rotationally coupled to the support assembly 12. The cable portion 30 of the drive member 26 extends around the pulley member 36 whereby the pulley member 36 rotates to provide a smooth operation of the drive member 26 when the drive assembly 16 is actuated by the user.

The drive assembly 16 comprises a sprocket member 38. The sprocket member 38 is coupled to the motor member 24 whereby the sprocket member 38 is selectively rotated by the motor member 24. The sprocket member 38 engages the chain portion 28 of the drive member 26 whereby the sprocket member 38 actuates the chain portion 28 of the drive member 26 to slide the carriage member 20 along the rail member 18 when the drive assembly 16 is actuated by the user.

The drive assembly 16 comprises a housing member 40. The housing member 40 is positioned around the motor member 24. The housing member 40 is designed for inhibiting moisture from contacting the motor member 24 to inhibit the motor member 24 is damaged by the moisture.

The drive assembly 16 comprises a transmitter assembly 42 and a receiver assembly 44. The receiver assembly 44 is operationally coupled to the motor member 24. The transmitter assembly 42 is positioned remotely from the receiver assembly 44. The transmitter assembly 42 transmitting an activation signal over free space to the receiver assembly 44 to actuate the motor member 24 to slide the carriage member 20 along the rail member 18 when the transmitter assembly 42 is actuated by the user.

The mail receiving member 14 comprises a perimeter wall 46. The perimeter wall 46 defines an interior space 48 of the mail receiving member 14. The interior space 48 comprises an open end whereby the open end is designed for permitting mail to is inserted into and retrieved from the interior space 48 of the mail receiving member 14.

A cover member 50 is pivotally coupled to the mail receiving member 14. The cover member 50 is selectively pivoted over the open end of the interior space 48 of the mail receiving member 14 to selectively close the open end to inhibit precipitation from entering the interior space 48 of the mail receiving member 14.

A signal member 52 is rotatably coupled the mail receiving member 14. The signal member 52 is selectively rotated to a first position to indicate to a mail carrier that mail is present in the mail receiving member 14 to be picked up by the mail carrier. The signal member 52 is selectively rotated to a second position to indicate to a mail carrier that there is no mail in the interior space 48 of the mail receiving member 14.

In use, the mail receiving member 14 is positioned adjacent the curb to receive mail from the mail carrier. The cover member 50 is pivoted and the mail carrier places mail in the interior space 48 of said mail receiving member 14 and closes the cover member 50 again. The user then actuates the transmitter assembly 42 to actuate the motor assembly to draw the mail receiving member 14 towards the house. The user opens the cover member 50 to retrieve the mail from the mail receiving member 14 when the mail receiving member 14 has reached the house to limit contact the user has with the elements when retrieving mail. The transmitter assembly 42 is actuated again to actuate the motor assembly to draw the mail receiving member 14 back to the curb to allow the mail receiving member 14 to receive mail from the mail carrier.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mail retrieval system for allowing a user to retrieve mail from a curb side location, the mail retrieval system comprising:

a support assembly being adapted for being positioned on a support surface, said support assembly having a first end and a second end;

a mail receiving member being coupled to said support assembly such that said mail receiving member is selectively transported along said support assembly; and a drive assembly coupled to said support assembly, said drive assembly being operationally coupled to said mail receiving assembly for transporting said mail receiving member along said support assembly when said drive assembly is actuated by the user;

wherein said support assembly comprises a rail member extending between said first end and said second end and a carriage member slidably mounted on said rail member for movement between said first end and said second end, said mail receiving member being mounted on said carriage member, said carriage member straddling said rail member;

said drive assembly comprises a drive member wherein said drive member includes a cable extending between said first end and said carriage member, and a chain extending between said carriage member and said second end, free ends of said cable being mounted on said carriage member and free ends of said chain being mounted on said carriage member.

2. The mail retrieval system as set forth in claim 1, further comprising:

said support assembly comprising a plurality of stanchion members, each of said stanchion members being coupled to said rail member, each of said stanchion members being adapted for engaging the support surface such that said stanchion members are for supporting said rail member above the support surface.

3. The mail retrieval system as set forth in claim 1, further comprising:

said drive assembly comprising a motor member, said motor member being operationally coupled to said carriage member of said support assembly such that said motor member is for sliding said carriage member along said rail member when said drive assembly is actuated by the user, said motor assembly being reversed each time said motor assembly is actuated such that said motor assembly slides said carriage member away from said motor member upon actuation of said drive assembly and slides said carriage member towards said motor member upon alternating actuations of said drive assembly, said motor assembly being adapted for being operationally coupled to a power source for supplying power to said motor member.

4. The mail retrieval system as set forth in claim 3, further comprising:

said drive member being operationally coupled between said motor member and said carriage member, said drive assembly being actuated by said motor assembly to slide said carriage member along said rail member when said drive assembly is actuated by the user.

5. The mail retrieval system as set forth in claim 3, further comprising:

said drive assembly comprising a housing member, said housing member being positioned around said motor member, said housing member being adapted for inhibiting moisture from contacting said motor member to inhibit said motor member being damaged by the moisture.

6. The mail retrieval system as set forth in claim 3 further comprising:

said drive assembly comprising a transmitter assembly and a receiver assembly, said receiver assembly being operationally coupled to said motor member, said transmitter assembly being positioned remotely from said receiver assembly, said transmitter assembly transmitting an activation signal over free space to said receiver assembly to actuate said motor member to slide said carriage member along said rail member when said transmitter assembly is actuated by the user.

7. The mail retrieval system as set forth in claim 1, further comprising:

said mail receiving member comprising a perimeter wall, said perimeter wall defining an interior space of said mail receiving member, said interior space comprising an open end such that said open end is adapted for permitting mail to being inserted into and retrieved from said interior space of said mail receiving member.

8. The mail retrieval system as set forth in claim 7, further comprising:

a cover member being pivotally coupled to said mail receiving member, said cover member being selectively pivoted over said open end of said interior space of said mail receiving member to selectively close said open end to inhibit precipitation from entering said interior space of said mail receiving member.

9. The mail retrieval system as set forth in claim 1, further comprising:

a signal member being rotatably coupled said mail receiving member, said signal member being selectively rotated to a first position to indicate to a mail carrier that mail is present in said mail receiving member to be picked up by the mail carrier, said signal member being selectively rotated to a second position to indicate to a mail carrier that there is no mail in said interior space of said mail receiving member.

10. The mail retrieval system of claim 1 comprising:

said support assembly comprising a plurality of stanchion members, each of said stanchion members being coupled to said rail member, each of said stanchion members being adapted for engaging the support surface such that said stanchion members are for supporting said rail member above the support surface;

said drive assembly comprising a motor member, said motor member being operationally coupled to said carriage member of said support assembly such that said motor member is for sliding said carriage member along said rail member when said drive assembly is actuated by the user, said motor assembly being reversed each time said motor assembly is actuated such that said motor assembly slides said carriage member away from said motor member upon actuation of said drive assembly and slides said carriage member towards said motor member upon alternating actuations of said drive assembly, said motor assembly being adapted for being operationally coupled to a power source for supplying power to said motor member;

said drive member being operationally coupled between said motor member and said carriage member, said drive assembly being actuated by said motor assembly to slide said carriage member along said rail member when said drive assembly is actuated by the user;

said drive assembly comprising a pulley member, said pulley member being rotationally coupled to said support assembly, said cable portion of said drive member extending around said pulley member such that said pulley member rotates to provide a smooth operation of said drive member when said drive assembly is actuated by the user;

said drive assembly comprising a sprocket member, said sprocket member being coupled to said motor member such that said sprocket member is selectively rotated by said motor member, said sprocket member engaging said chain portion of said drive member such that said sprocket member actuates said chain portion of said drive member to slide said carriage member along said rail member when said drive assembly is actuated by the user;

said drive assembly comprising a housing member, said housing member being positioned around said motor member, said housing member being adapted for inhibiting moisture from contacting said motor member to inhibit said motor member being damaged by the moisture;

said drive assembly comprising a transmitter assembly and a receiver assembly, said receiver assembly being operationally coupled to said motor member, said transmitter assembly being positioned remotely from said receiver assembly, said transmitter assembly transmitting an activation signal over free space to said receiver assembly to actuate said motor member to slide said carriage member along said rail member when said transmitter assembly is actuated by the user;

said mail receiving member comprising a perimeter wall, said perimeter wall defining an interior space of said mail receiving member, said interior space comprising an open end such that said open end is adapted for permitting mail to being inserted into and retrieved from said interior space of said mail receiving member;

a cover member being pivotally coupled to said mail receiving member, said cover member being selectively pivoted over said open end of said interior space of said mail receiving member to selectively close said open end to inhibit precipitation from entering said interior space of said mail receiving member; and a signal member being rotatably coupled said mail receiving member, said signal member being selectively rotated to a first position to indicate to a mail carrier that mail is present in said mail receiving member to be picked up by the mail carrier, said signal member being selectively rotated to a second position to indicate to a mail carrier that there is no mail in said interior space of said mail receiving member.

11. A mail retrieval system for allowing a user to retrieve mail from a curb side location, the mail retrieval system comprising:

a support assembly being adapted for being positioned on a support surface such that said support assembly extends between a curb and a house;

a mail receiving member being coupled to said support assembly such that said mail receiving member is selectively transported along said support assembly, said mail receiving member being adapted for receiving mail when said mail receiving member is positioned adjacent the curb, said mail receiving member permitting a user to retrieve the mail when said mail receiving member is transported along said support assembly to be positioned proximate the house;

a drive assembly coupled to said support assembly, said drive assembly being operationally coupled to said mail receiving assembly such that said drive assembly is for transporting said mail receiving member along said support assembly when said drive assembly is actuated by the user;

said support assembly comprising a rail member and a carriage member, said carriage member being slidably coupled to said rail member such that said carriage member selectively slides along a length of said rail member, said carriage member being operationally coupled to said drive assemblv such that said drive assembly is for sliding said carriage member alone said rail member when said drive assembly is actuated by the user, said mail receiving member being coupled to said carriage member such that said mail receiving member is transported along said rail member when said carriage member is slid along said rail member by said drive assembly;

said drive assembly comprising a motor member, said motor member being operationally coupled to said carriage member of said support assembly such that said motor member is for sliding said carriage member along said rail member when said drive assembly is actuated by the user, said motor assembly being reversed each time said motor assembly is actuated such that said motor assembly slides said carriage member away from said motor member upon actuation of said drive assembly and slides said carriage member towards said motor member upon alternating actuations of said drive assembly, said motor assembly being adapted for being operationally coupled to a power source for supplying power to said motor member;

said drive assembly comprising a drive member, said drive member being operationally coupled between said motor member and said carriage member, said drive assembly being actuated by said motor assembly to slide said carriage member along said rail member when said drive assembly is actuated by the user;

said drive member comprising a chain portion and a cable portion, said chain portion being coupled to said cable portion, a free end of said chain portion being coupled to said carriage member, a distal end of said cable portion being coupled to said carriage member opposite said free end of said chain portion, said chain portion of said drive member being operationally coupled to said motor member such that said free end of said chain portion is selectively drawn closer to said motor assembly to slide said carriage member along said rail member towards said motor member when said drive assembly is actuated by the user, said cable member being operationally coupled to said support assembly such said chain portion pulls on said cable portion to draw said distal end of said cable portion away from said motor member to slide said cable assembly along, said rail member away from said motor member upon alternating actuations of said drive assembly.

12. The mail retrieval system as set forth in claim 11, further comprising:

said drive assembly comprising a pulley member, said pulley member being rotationally coupled to said support assembly, said cable portion of said drive member extending around said pulley member such that said pulley member rotates to provide a smooth operation of said drive member when said drive assembly is actuated by the user.

13. The mail retrieval system as set forth in claim 11, further comprising:

said drive assembly comprising a sprocket member, said sprocket member being coupled to said motor member such that said sprocket member is selectively rotated by said motor member, said sprocket member engaging said chain portion of said drive member such that said sprocket member actuates said chain portion of said drive member to slide said carriage member along said rail member when said drive assembly is actuated by the user.

14. A mail retrieval system for allowing a user to retrieve mail from a curb side location, the mail retrieval system comprising:

a support assembly being adapted for being positioned on a support surface such that said support assembly extends between a curb and a house;

a mail receiving member being coupled to said support assembly such that said mail receiving member is selectively transported along said support assembly, said mail receiving member being adapted for receiving mail when said mail receiving member is positioned adjacent the curb, said mail receiving member permitting a user to retrieve the mail when said mail receiving member is transported along said support assembly to be positioned proximate the house;

a drive assembly coupled to said support assembly, said drive assembly being operationally coupled to said mail receiving assembly such that said drive assembly is for transporting said mail receiving member along, said support assembly when said drive assembly is actuated by the user;

said support assembly comprising a rail member and a carriage member, said carriage member being slidably coupled to said rail member such that said carriage member selectively slides along a length of said rail member, said carriage member being operationally coupled to said drive assembly such that said drive assembly is for sliding said carriage member along said rail member when said drive assembly is actuated by the user, said mail receiving member being coupled to said carriage member such that said mail receiving member is transported along said rail member when said carriage member is slid along said rail member by said drive assembly;

said drive assembly comprising a motor member, said motor member being operationally coupled to said carriage member of said support assembly such that said motor member is for sliding said carriage member along said rail member when said drive assembly is actuated by the user, said motor assembly being reversed each time said motor assembly is actuated such that said motor assembly slides said carriage member away from said motor member upon actuation of said drive assembly and slides said carriage member towards said motor member upon alternating actuations of said drive assembly, said motor assembly being adapted for being operationally coupled to a power source for supplying power to said motor member;

said drive assembly comprising a transmitter assembly and a receiver assembly, said receiver assembly being operationally coupled to said motor member, said transmitter assembly being positioned remotely from said receiver assembly, said transmitter assembly transmitting an activation signal over free space to said receiver assembly to actuate said motor member to slide said carriage member along said rail member when said transmitter assembly is actuated by the user.

* * * * *